US006966589B1

(12) United States Patent
Grbic

(10) Patent No.: US 6,966,589 B1
(45) Date of Patent: Nov. 22, 2005

(54) FLEXIBLE CARRIER APPARATUS AND METHOD FOR TRACKING THE SAME

(76) Inventor: George Grbic, 8350 Northcote Ave., Munster, IN (US) 46321

( * ) Notice: Subject to any disclaimer, the term of this patent is extended or adjusted under 35 U.S.C. 154(b) by 0 days.

(21) Appl. No.: 10/354,755

(22) Filed: Jan. 30, 2003

(51) Int. Cl.[7] ..... A45F 5/10
(52) U.S. Cl. ..... 294/150; 294/154; 294/157
(58) Field of Search ..... 294/137, 150, 294/152–154, 157, 159, 164, 165, 170; 24/16 R, 24/17 A, 17 B

(56) References Cited

U.S. PATENT DOCUMENTS

| | | | | | |
|---|---|---|---|---|---|
| 217,230 | A | * | 7/1879 | Lyman | 294/154 |
| 466,670 | A | * | 1/1892 | Fler | 294/152 |
| 2,485,864 | A | * | 10/1949 | Cohen et al. | 294/156 |
| 2,486,827 | A | | 11/1949 | Duncan | |
| 3,119,160 | A | | 1/1964 | Hoppeler | |
| 3,493,154 | A | * | 2/1970 | Engle | 294/150 |
| 4,469,363 | A | | 9/1984 | Kalla | |
| 4,586,745 | A | * | 5/1986 | Shepard | 294/150 |
| 4,724,989 | A | | 2/1988 | Silberberg | |
| 5,096,248 | A | | 3/1992 | Ryan | |
| 5,599,052 | A | * | 2/1997 | Van Davelaar | 294/159 |
| D433,812 | S | * | 11/2000 | Newby | D3/327 |
| 6,511,114 | B1 | * | 1/2003 | Fludd | 294/159 |

* cited by examiner

*Primary Examiner*—Dean J. Kramer
(74) *Attorney, Agent, or Firm*—Patula & Associates, P.C.

(57) ABSTRACT

A flexible carrier apparatus comprising two rigid independent rods and two flexible material straps. The flexible straps are attached to the opposite ends of the rigid rods. One rigid rod is placed under and then above the other rigid rod, thus creating two independent nooses from the flexible straps.

3 Claims, 4 Drawing Sheets

FLEXIBLE CARRIER APPARATUS AND METHOD FOR TRACKING THE SAME

The present invention relates generally to the field of bundling, carrying and storing of objects, more particularly, to carrying devices with flexible straps. Specifically, the present invention is a carrying device having two parallel rigid rods connected with two independent flexible straps. The present invention is configured in such a way as to create two self-tightening nooses which facilitate the bundling, carrying and storing attributes of the invention.

BACKGROUND OF THE INVENTION

In the past, in order to move a bundle of objects, the bundle typically had to be manually tied together such that the unified bundle could be carried by hand. Examples of such objects include blue prints, fishing poles, clothing to be laundered, firewood, etc. The user would then carry the unified bundle by hand. When the unified bundle reached its destination, the user would then have to untie or cut the rope in order to release the individual objects from the bundle. Therefore, if the user wanted to move the remaining individual objects again, he would have to repeat the process of retying the rope or twine.

The process is very inefficient because of the time it takes to tie and untie the rope. In addition, there is the possibility that an individual object may accidentally fall out of the unified bundle causing the user to retie the individual objects again. Also, tying the bundle is inefficient because when the user desires to remove one individual object from the unified bundle, the rope would have to be untied in order to facilitate removal.

Also, once the unified bundle is dropped off at a location, it is often quite difficult to keep track of its location and identification. For example, if a unified bundle of laundry is dropped off at a laundry service establishment, quite often the establishment's employees need to individually mark each bundled item for tracking and identification purposes. This becomes quite tedious because the unified bundle must be separated in order to properly mark each item.

There are numerous prior art devices used to transport items. For example, U.S. Pat. No. 2,486,827 to Duncan, issued on Nov. 1, 1949, teaches the ability to use flexible straps such as rubber, fabric or leather to bundle and carry golf clubs. Two individual flexible straps running parallel to each other are fixedly attached to a rigid pole at one end. The opposite ends of the straps are fixedly attached to an endless looping device, such as a buckle. The straps are then feed through the endless looping device to create a self-tightening noose. When golf club shafts are placed within the self-tightening noose created by the flexible straps and when the rigid pole is lifted vertically, the weight of the golf club shafts cause the flexible straps to automatically tighten around the golf club shafts, thereby creating a tight grip around the golf club bundle. However, an apparent disadvantage of the '827 patent is that the flexible straps must be fixedly attached to an endless looping device. This severely limits the carrier's potential capabilities by placing a limit on the amount of items to be carried within the self-tightening noose as well as negating the ability of disassembling the noose if required. Furthermore, the flexible strap attachment point to the endless looping device creates a weak point that can cause frequent strap failure. Lastly, upon placement of elongated items into the carrier, the buckle will be in direct contact with the items. As such, the buckle will have a tendency to rub against and thus mar the items which are being carried. The present invention overcomes these limitations by, for example, removing the need for an endless looping device.

U.S. Pat. No. 4,469,363 to Kalla, issued on Sep. 4, 1984, discloses a firewood carrier comprised of continuous length tendons with intersecting portions. The '363 patent's sling-carrier device uses parallel tendons of approximately equally length which criss-cross each other defining the intersection portions. The free ends of the tendons are looped under and extend beyond the closed end of the tendons to create a self-tightening loop. However, a limitation to the '363 patent is its inability to effectively handle smaller items because the handle length becomes increasingly large. As such, when a user carries smaller items, the bundled items will have a tendency to be dragged along the ground. Furthermore, the '363 patent's usefulness is limited due to the intersecting portions which subsequently limit the device's flexibility. The present invention overcomes these limitations by, for example, not requiring intersecting portions and being readily adaptable to bundling smaller items. Furthermore, the present invention utilizes a plurality of flexible straps, whereas the '363 patent uses a contiguous tendon.

U.S. Pat. No. 3,119,160 to Hoppeler, issued on Jan. 28, 1964, discloses a device for binding and facilitating the transportation of objects. The '160 patent uses a hollowed handle with a channel encapsulated therein. On the opposite side of the handle is fixedly attached a continuous rope, wherein one end of the rope is attached to one side of the handle and the other end of the rope is attached to the opposite side of the handle. To facilitate bundling, the '160 patent wraps the rope around elongated items and "locks" the rope into the channel on the hollow handle. However, a limitation to the '160 patent is its inability to automatically adjust the loop diameter, thus not being able to adequately tighten and secure elongated items within the loop. However, the present invention overcomes this limitation by, for example, providing a self-tightening noose, which can effectively bundle numerous configurations, sizes and amounts of elongated items.

U.S. Pat. No. 4,724,989 to Silberberg, issued on Feb. 16, 1988, discloses a sailboard carrying apparatus. The device consists of an elongated rod with two independent loops of flexible material. However, a limitation of the '989 patent is that the loops of flexible material cannot be easily adjusted. As such, the loops do not automatically tighten around the items being carried and thus allow the items to easily fall out. The present invention overcomes this limitation by, for example, allowing the nooses to automatically tighten around elongated items by displacing their weight, thus further securing the items while they are being carried.

U.S. Pat. No. 5,096,248 to Ryan, issued on Mar. 17, 1992, discloses a bundling handle. The bundling handle contains a handle fixedly attached to one end of a single strap and a buckle at the other end of the strap. The device creates a self-tightening loop by wrapping the handle and strap portion around a load to be bundled and inserting the handle through the buckle portion. When the handle is lifted vertically, the vertical upward force displaces the weight of the items being carried, thus automatically tightening the loop around the items. However, a limitation to the '248 patent is that it is not practical for bundling and carrying elongated items because there is only one strap creating the carrying loop. As such, when long items are bundled and carried in the '248 patent, they are balanced awkwardly and the user does not maintain proper control. The present invention overcomes this limitation by, for example, using a longer handle which allows the attachment of a plurality of independent flexible straps to be spaced apart. This subsequently creates more stabilizing loops which can easily and controllably carry elongated items.

OBJECTS OF THE INVENTION

It is an object of the present invention to provide a novel and improved carrier to facilitate bundling, transportation and storage of elongated objects, such as firewood, fishing poles, items to be laundered, blue prints and the like.

It is yet another object of the present invention to provide a re-usable, self-tightening apparatus that can be easily and conveniently closed and opened for the removal of individual elongated objects.

It is yet another object of the present invention to provide a means of identifying or tagging the carrier apparatus for easy tracking and identification.

Numerous other objects, features and advantages of the present invention will become readily apparent through the detailed description of the preferred embodiment, drawings and the claims.

SUMMARY OF THE INVENTION

The present invention comprises an improved carrying device to facilitate bundling, transportation and storage of objects, and in particular, elongated objects. The preferred embodiment entails the use of two flexible straps. Both straps are fixedly attached at one end to the opposite ends of a rigid rod. The remaining ends of the flexible straps are fixedly attached to the opposite ends of an independent rigid rod being of slightly less length than the first rigid rod.

The second, slightly shorter rigid rod is thus placed under and around the first longer rigid rod, whereby creating a noose with the flexible straps. Elongated items, such as fishing rods, firewood, blue prints, items to be laundered, or the like, are thus placed within the nooses. It is to be understood, of course, that the use and application of the present invention is limitless and the foregoing item examples are not to be used to limit the scope or spirit of the invention.

When the second, shorter rod is lifted vertically, the weight of the elongated items thus causes the nooses of the flexible straps to automatically tighten around the elongated items. The items can then be easily carried to their destination. When it is desired to remove an individual object from the bundle, the shorter rigid rod is lower until the elongated objects' weight is displaced by a bottom force, such as the ground or a flat table, thus relieving the tension in the flexible straps and loosening the noose.

The preferred embodiment further entails a means for identifying the carrier apparatus for easy tracking. In the preferred embodiment, the means for identifying the carrier apparatus entails the use of marking the apparatus with a bar code reading system to facilitate easy tracking and identification. Alternate embodiments of the present invention use a tagging means, marking means, global positioning means and the like to facilitate tracking and identification. It is to be understood, of course, that any type of identification or tracking method can be effectively utilized to identify or track the carrier apparatus. As such, it is to be understood that the above-described examples should not limit the scope or spirit of the present invention.

DESCRIPTION OF THE DRAWINGS

A preferred embodiment of the present invention is described herein with reference to the drawings wherein.

DETAILED DESCRIPTION OF THE PREFERRED EMBODIMENT

While the invention is susceptible of embodiment in many different forms, there will be described herein in detail, preferred and alternate embodiments of the present invention. It should be understood, however, that the present disclosure is to be considered an exemplification of the principles of the invention and is not intended to limit the spirit and scope of the invention and/or claims of the embodiments illustrated.

Figure 1:
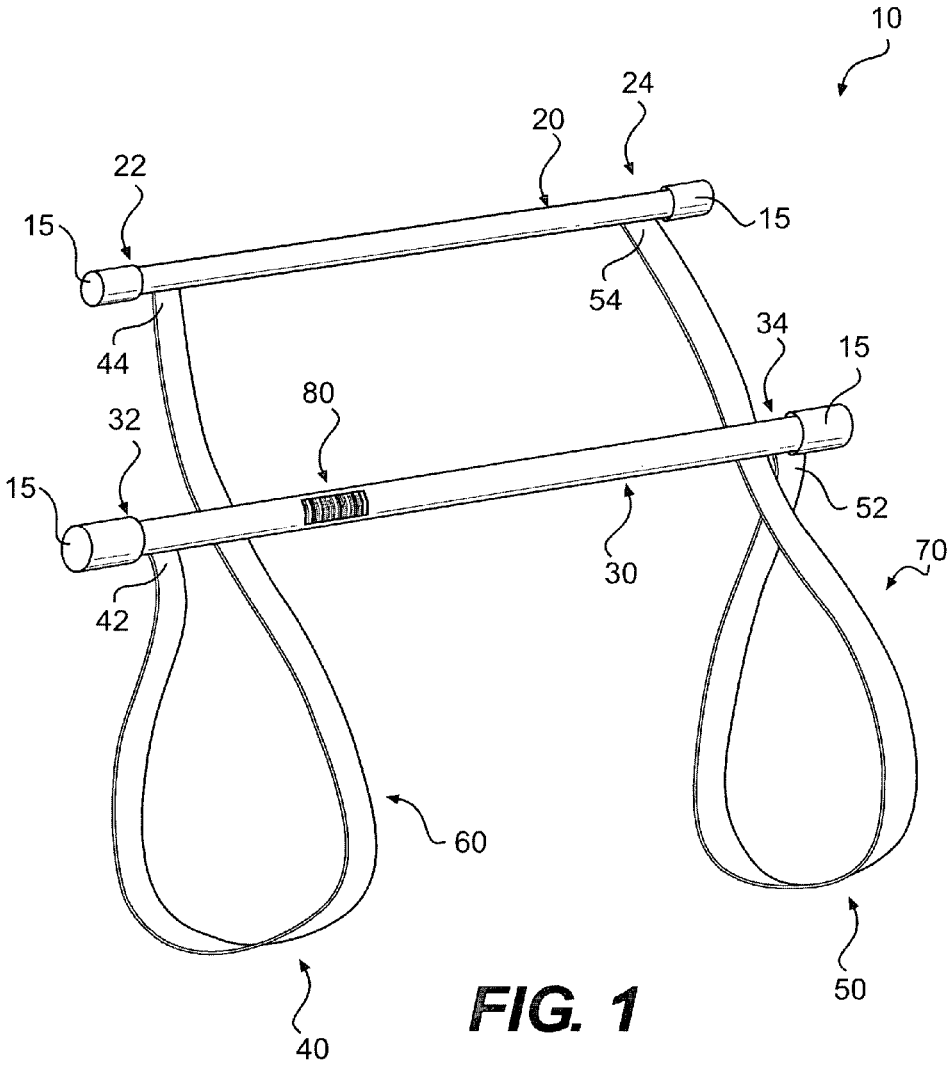
FIG. 1 is a perspective view of the flexible carrier apparatus showing the apparatus with noosing configuration enabled.

Referring to FIG. 1, a preferred embodiment of the present invention 10 contains two rigid, elongated rods 20 and 30. The rods can be constructed of any rigid material, such as a metallic base material, plastic, wood, and the like. Within the preferred embodiment, rigid rod 20 is shorter than rigid rod 30 to facilitate the ease of self-noosing the apparatus. An alternate embodiment of the present invention has both rigid rods 20 and 30 being the same length. The preferred embodiment of the present invention further provides end caps 15 for safety purposes to ensure that the ends of rigid rods 20 and 30 are not sharp.

The preferred embodiment of the present invention also contains two flexible straps 40 and 50, preferably of equal length. The flexible straps can be constructed of any flexible material such as rubber, plastic, fabric, leather, canvas, and the like. Within the preferred embodiment, one end 42, 52 respectively of flexible straps 40 and 50 are attached at opposite ends 32, 34 of rigid rod 30. Each strap 40, 50 is attached to a respective end 32, 34 of rigid rod 30 whereby a fixed distance separates them. It is foreseen however that the straps 40 and 50 could be adjustably attached to the rods 20 and 30 to allow the distance between the straps 40 and 50 to be adjustable. The other ends 44, 54 respectively of the flexible straps 40 and 50 are attached to the opposite ends 22, 24 of the other rigid rod 20. Each opposite end 44, 54 of the flexible straps 40, 50 respectively are attached to a respective end 22, 24 of rigid rod 20 whereby they are separated by a fixed distance. Again, adjustability is foreseen.

A self-tightening noose 60, 70 is created with each of the flexible straps 40 and 50 by placing rigid rod 20 under and then above rigid rod 30. Elongated items, such as fishing poles, blue prints, items to be laundered, firewood and the like, are placed in the self-tightening nooses. When rigid rod 20 is lifted vertically, thus displacing the weight of the individual elongated items, the self-tightening noose size is automatically decreased, thus ensuring a tight, secure fit around the bundled elongated items.

Rigid rod 20 is subsequently used as a carrying handle to facilitate the transportation of the flexible carrier apparatus and contained elongated items. When it is desired to remove one, some or all of the elongated items from the self-tightening nooses, rigid rod 20 is lowered until the weight of the individual elongated items is displaced by a surface, preferably flat, such as the ground or a flat table. The weight displacement will automatically decrease the tension in flexible straps 40 and 50, thus loosening the self-tightening nooses to facilitate item removal.

The preferred embodiment further entails a means 80 for identifying the carrier apparatus for easy tracking, for example in a laundry service establishment. In the preferred embodiment, the means 80 for identifying the carrier apparatus entails the use of marking the apparatus with a bar code reading system to facilitate easy tracking and identification.

Figure 4:
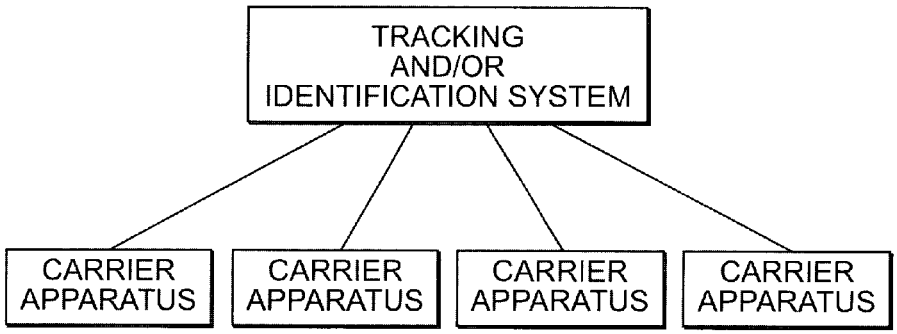
FIG. 4 is a schematic diagram of the tracking and/or identification system of the present disclosure.

A schematic diagram of the tracking and/or identification system described herein is illustrated generally in FIG. 4. The tracking system could take the form of, for example, a GPS system.

Alternate embodiments of the present invention use a means for marking or tagging to facilitate tracking and identification. It is to be understood, of course, that any type of identification or tracking method can be effectively utilized to identify or track the carrier apparatus. As such, it is to be understood that the above-described examples should not limit the scope or spirit of the present invention.

Figure 3:
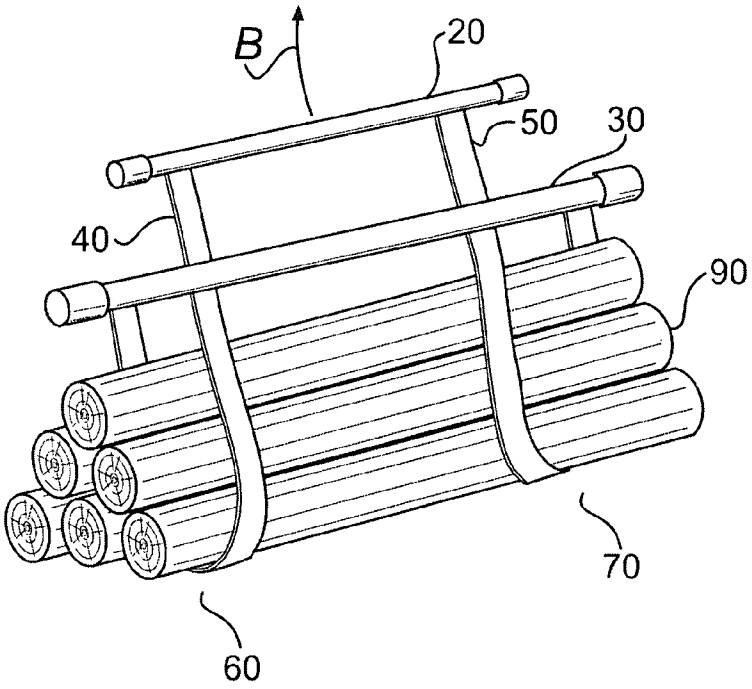
FIG. 3 is a perspective view of the flexible carrier apparatus positioned to transport objects.
Figure 2:
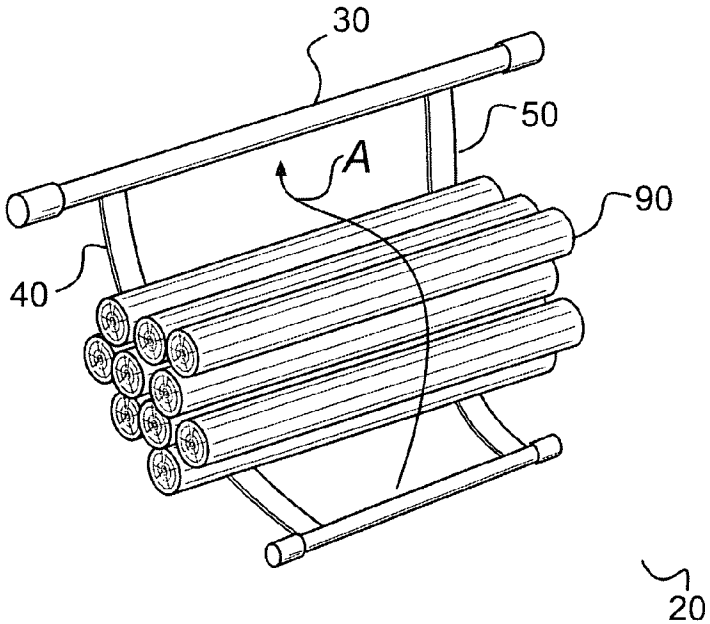
FIG. 2 is a perspective view of the flexible carrier apparatus being loaded with objects.

FIGS. 2 and 3 illustrate the present invention 10 in use. As shown in FIG. 2, objects 90 to be carried are placed upon the flexible straps 40 and 50 with the rods 20, 30 spaced apart. A self-tightening noose 60, 70 is created with each of the flexible straps 40 and 50 by placing rigid rod 20 under and then above rigid rod 30 as indicated by the direction of Arrow A. This results in the configuration shown in FIG. 3. When rigid rod 20 is lifted vertically, as indicated by the direction of Arrow B in FIG. 3, the weight of the individual elongated items is displaced and the self-tightening noose size is automatically decreased, thus ensuring a tight, secure fit of each noose around the bundled elongated items, regardless of variations in the size of the bundled items at each noose.

The foregoing specification describes only the preferred embodiment of the invention as shown. Other embodiments besides the above may be articulated as well. The terms and expressions therefore serve only to describe the invention by example only and not to limit the invention. It is expected that others will perceive differences, which while differing from the foregoing, do not depart from the spirit and scope of the invention herein described and claimed. For example, it is foreseen that the rods 20 and 30 could be of equal length, and still function as described above. The placement of one under and then above the other could be achieved by a simple angling of one of the rods or both rods. Further, the straps 40 and 50 could be fixed to rods 20 and 30, or could be removably and adjustably attached thereto via any suitable means such as buckles, hooks and eyelets, hook and loop type fasteners, etc.

Still further, for longer items such as piping, additional nooses may be added. For example, rod 30 could be of greater length, and have four straps attached thereto. Two of the straps on one half of rod 30 could attach to a first rod 20, while the other two straps on the other half of rod 30 could attach to a second rod 20. Four nooses could then be formed as described, with the resulting carrier having two handles. Alternatively, two separate carriers could be used on longer bundles.

Figure 5:
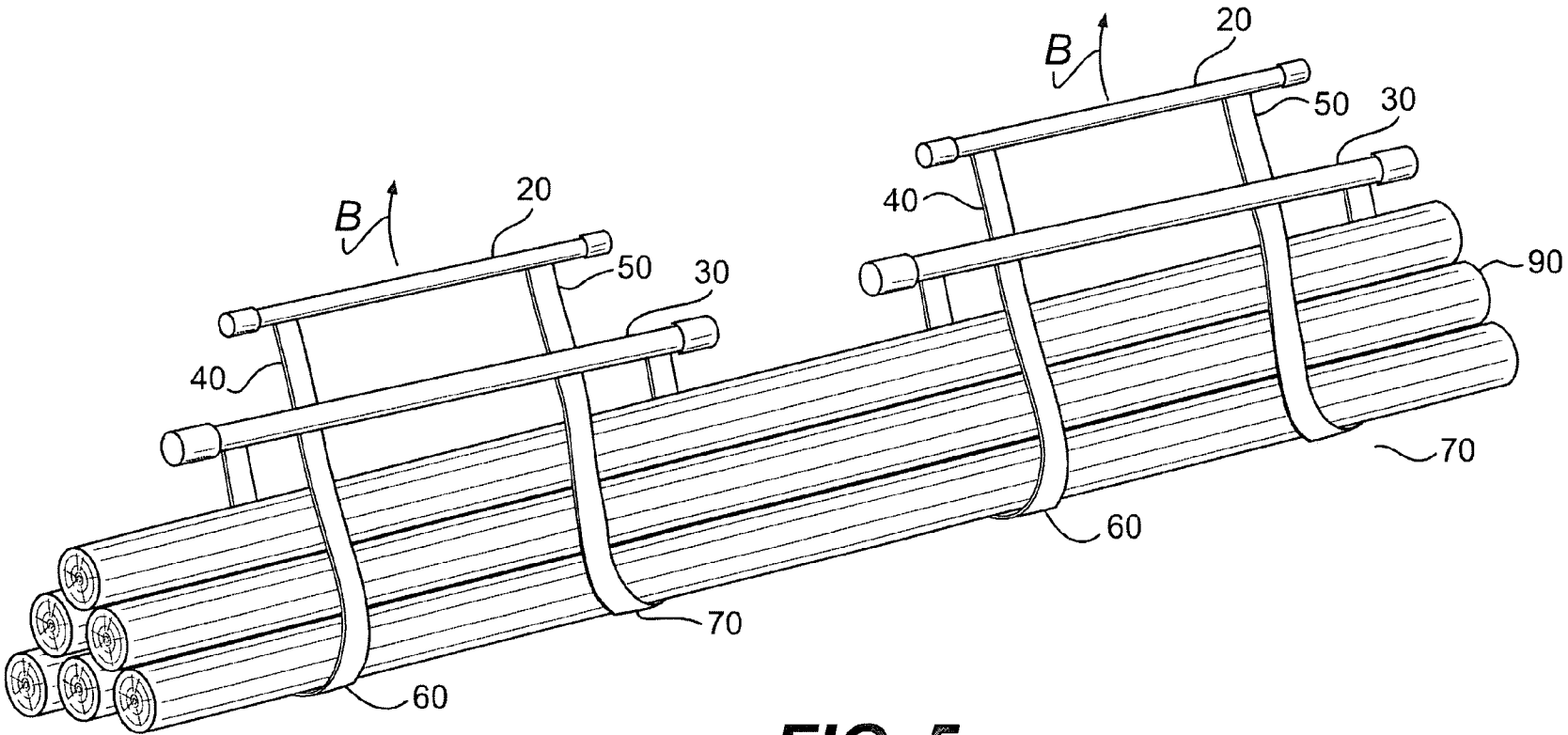
FIG. 5 is a perspective view of two flexible carrier apparatuses positioned to transport objects.

FIG. 5 illustrates the use of two carriers on a longer bundle, as discussed above.

What is claimed is:

1. A device for bundling and facilitating the transportation of items, comprising:

at least two rigid rods, including a first rigid rod and a second rigid rod;

at least two flexible straps, including a first flexible strap and a second flexible strap each having a first and second end, said first end of said first and second flexible straps being attached to opposite ends of said first rigid rod at a spaced apart distance, said second end of said first and second flexible straps being attached to opposite ends of said second rigid rod at a spaced apart distance; and said first rigid rod adapted to be placed under and then above said second rigid rod thereby creating a plurality of independent nooses with said first and second flexible straps;

wherein said at least two rigid rods further including a third rigid rod and a fourth rigid rod, and said at least two flexible straps further including a third flexible strap and a fourth flexible strap each having a first and second end, said first end of said third and fourth flexible straps being attached to opposite ends of said third rigid rod at a spaced apart distance, said second end of said third and fourth flexible straps being attached to opposite ends of said fourth rigid rod at a spaced apart distance; and said third rigid rod adapted to be placed under and then above said fourth rigid rod thereby creating a plurality of independent nooses with said third and fourth flexible straps; and a global positioning element on the device for determining the location of the device.

2. A device for bundling and facilitating the transportation of items, comprising:

at least two rigid rods, including a first rigid rod and a second rigid rod;

at least two flexible straps, including a first flexible strap and a second flexible strap each having a first and second end, said first end of said first and second flexible straps being attached to opposite ends of said first rigid rod at a spaced apart distance, said second end of said first and second flexible straps being attached to opposite ends of said second rigid rod at a spaced apart distance;

said first rigid rod adapted to be placed under and then above said second rigid rod thereby creating a plurality of independent nooses with said first and second flexible straps; and a means for tracking said device, wherein said means for tracking is a global positioning system.

3. A device for bundling and facilitating the transportation of items, comprising:

at least two rigid rods, including a first rigid rod and a second rigid rod;

at least two flexible straps, including a first flexible strap and a second flexible strap each having a first and second end, said first end of said first and second flexible straps being attached to opposite ends of said first rigid rod at a spaced apart distance, said second end of said first and second flexible straps being attached to opposite ends of said second rigid rod at a spaced apart distance;

said first rigid rod adapted to be placed under and then above said second rigid rod thereby creating a plurality of independent nooses with said first and second flexible straps;

a means for tracking said device; and a tracking system for determining the location of the device, the tracking system being operatively associated with the means for tracking.

* * * * *